US007520336B2

(12) United States Patent
Mondelli et al.

(10) Patent No.: US 7,520,336 B2
(45) Date of Patent: Apr. 21, 2009

(54) MULTIPLE DART DROP CIRCULATING TOOL

(75) Inventors: Maximiliano Mondelli, Houston, TX (US); George Krieg, Youngsville, LA (US); David Hebert, Scott, LA (US); David Robinson, Cypress, TX (US)

(73) Assignee: BJ Services Company, Houston, TX (US)

( * ) Notice: Subject to any disclaimer, the term of this patent is extended or adjusted under 35 U.S.C. 154(b) by 246 days.

(21) Appl. No.: 11/654,350

(22) Filed: Jan. 16, 2007

(65) Prior Publication Data

US 2008/0169108 A1 Jul. 17, 2008

(51) Int. Cl.
*E21B 34/14* (2006.01)
*E21B 23/00* (2006.01)

(52) U.S. Cl. ..... 166/386; 166/318; 166/331

(58) Field of Classification Search ..... 166/318, 166/331, 373, 386
See application file for complete search history.

(56) References Cited

U.S. PATENT DOCUMENTS

| | | | | | |
|---|---|---|---|---|---|
| 3,545,542 | A | | 12/1970 | Scott | 166/155 |
| 3,616,850 | A | | 11/1971 | Scott | 166/155 |
| 3,730,267 | A | | 5/1973 | Scott | 166/335 |
| 4,889,199 | A | | 12/1989 | Lee | 175/317 |
| 5,127,472 | A | | 7/1992 | Watson et al. | 166/177.3 |
| 5,174,379 | A | * | 12/1992 | Whiteley et al. | 166/278 |
| 5,366,019 | A | | 11/1994 | Brooks | |
| 5,499,687 | A | | 3/1996 | Lee | 175/317 |
| 5,797,454 | A | | 8/1998 | Hipp | 166/196 |
| 5,890,540 | A | | 4/1999 | Pia et al. | 166/321 |
| 5,971,079 | A | | 10/1999 | Mullins | 166/387 |
| 6,056,053 | A | | 5/2000 | Giroux et al. | |
| 6,378,612 | B1 | | 4/2002 | Churchill | |
| 6,408,945 | B1 | * | 6/2002 | Telfer | 166/311 |
| 6,491,103 | B2 | * | 12/2002 | Allamon et al. | 166/318 |
| 6,732,793 | B1 | | 5/2004 | Lee | 166/222 |

(Continued)

FOREIGN PATENT DOCUMENTS

WO WO 2005/049960 6/2005

OTHER PUBLICATIONS

PCT International Search Report and Written Opinion dated Jul. 29, 2008, issued for PCT Application No. PCT/US2008/051095, filed Jan. 15, 2008.

(Continued)

*Primary Examiner*—Shane Bomar
(74) *Attorney, Agent, or Firm*—Howrey LLP

(57) ABSTRACT

A downhole device used to divert fluid flow out of a work string. The downhole device may be located at any point along a work string at which it may be necessary to divert the fluid flow to the annulus. The downhole device may be activated and deactivated by inserting a single deformable dart into the work string. The device catches the dart blocking fluid flow through the work string. Increased fluid pressure activates the device, which diverts the fluid flow out of the work string into the annulus. A locating sleeve with a continuous j-track allows the device to be retained in activated position. The dart is adapted to deform under a predetermined amount of fluid pressure allowing the dart past the device and returning fluid flow through the work string. The downhole device may be activated multiple times without removing the downhole device from the wellbore.

39 Claims, 3 Drawing Sheets

U.S. PATENT DOCUMENTS

| | | | | |
|---|---|---|---|---|
| 6,769,490 | B2 | 8/2004 | Allamon et al. | |
| 6,820,697 | B1 | 11/2004 | Churchill | 166/374 |
| 6,920,930 | B2 | 7/2005 | Allamon et al. | 166/318 |
| 6,923,255 | B2 | 8/2005 | Lee | 166/154 |
| 7,032,668 | B2 * | 4/2006 | Mondelli et al. | 166/291 |
| 7,347,289 | B2 * | 3/2008 | Lee | 175/317 |
| 2004/0011566 | A1 | 1/2004 | Lee | 175/317 |
| 2004/0099447 | A1 | 5/2004 | Howlett et al. | 175/317 |
| 2005/0072572 | A1 | 4/2005 | Churchill | 166/319 |
| 2005/0103504 | A1 * | 5/2005 | Szarka | 166/386 |
| 2005/0217864 | A1 | 10/2005 | Carmichael | 166/382 |
| 2007/0181313 | A1 * | 8/2007 | Churchill | 166/374 |

OTHER PUBLICATIONS 13 3/8" PDC Subsea Cement Plug Assembly, BJ Services Company, Oct. 31, 2000.

* cited by examiner

MULTIPLE DART DROP CIRCULATING TOOL

BACKGROUND OF THE INVENTION

1. Field of the Invention

The present invention relates generally to a downhole device that may be used to divert fluid out of a work string and into the annulus between the work string and the tubing or casing. The downhole device may be located at any point along a work string at which it may be necessary to divert the fluid flow to the annulus. The downhole device may be activated and deactivate inserting a single dart into the work string. The device catches the dart, which blocks the fluid flow through the work string. The increased fluid pressure due to the blocked flow path activates the device, which diverts the fluid flow out of the work string into the annulus. The increased fluid pressure moves a circulating sleeve within the device to align fluid ports allowing fluid flow into the annulus. A locating sleeve with a continuous j-track allows the device to be retained in activated position. The dart is adapted to deform under a predetermined amount of fluid pressure, thus passing the dart past the device and returning fluid flow through the work string. The downhole device may be activated multiple times without removing the downhole device from the wellbore.

2. Description of the Related Art

In the oil and gas industry long tubular work strings are often used in drilling, completion, displacement, and/or work over operations. Often the work string is used to carry fluid down the well to a tool located at the end of the work string. For example, fluid may be circulated down a work string and out of a drill bit located at the end of the work string. Often drilling mud is pumped down the work string and through the drill bit. The drilling mud acts as a lubricant, but also carries the drill cuttings up the annulus around the work string to the surface.

Under certain circumstances it may be desirable to circulate fluid into the annulus surrounding the work string at a particular location. For example, the drilling mud may be entering into a porous well formation instead of properly circulating the drill cuttings to the surface. In this instance, it may be necessary to inject a sealing agent into the formation in an attempt to prevent the future loss of mud into the formation. A number of systems have been disclosed that enable the circulation of fluid to the annulus without having to remove the work string from the well bore.

U.S. Pat. No. 4,889,199 discloses a downhole device that allows annular circulation after dropping a plastic ball into the work string. The work string is broken at the surface and a plastic ball is dropped into the work string. The work string is then reconnected and fluid is pumped into the work string until the ball reaches the downhole device. The downhole device includes a shoulder that is adapted to catch the ball within the work string. Once seated on the shoulder the ball blocks the fluid flow through the work string and continual pumping of fluid causes fluid pressure to build above the seated ball. The device includes a ported sleeve that is adapted to move within the device. The sleeve is biased to an initial position by a spring. Once the force on the ball due to the fluid pressure is greater than the spring force, the ported sleeve moves within the device such that ports in the sleeve align with exterior ports in device allowing fluid to be circulated out of the work string into the annulus. When the sleeve is in its initial position the exterior ports in the work string are sealed preventing fluid flow to the annulus.

To remove the ball from the shoulder in the device, a number of smaller steel balls must be dropped into the work string, which again requires that the work string be disconnected at the surface. The number of steel balls inserted into the work string must be equal to the number of annular ports in the sleeve. The work string is then reconnected and fluid is pumped until the steel balls reach the downhole device. The steel balls are sized such that they fit within the sleeve ports blocking the fluid flow to the annulus. With the fluid flow to the annulus blocked by the steel balls and the fluid flow through the work string prevented by the plastic ball, the fluid pumped into the work string causes the fluid pressure within the work string to increase above the device until the plastic ball is deformed and pushed past the shoulder. The deformed plastic ball falls into a housing located at the bottom of the device. This allows fluid to once again flow through the work string past the device and the steel balls, which are sized smaller than the plastic ball, pass the shoulder and also are captured in the housing below the device. The sleeve is returned to its initial position due to the biasing spring until the next plastic ball is inserted into the work string.

While the disclosed device does provide for annular flow out of the work string it requires that the work string be broken each time fluid flow is diverted out of the work string and each time fluid flow is returned. This process causes increases in well services costs as well as providing multiple opportunities for operator error. Further, the disclosed device requires the use of multiple balls on each cycle. These balls accumulate below the device in the housing or alternatively are dropped into the well. The large number of balls requires a rather large housing or alternatively requires that the device be brought to the surface frequently to remove the passed balls.

The use of a plastic ball may make it difficult for operators or well service providers to accurately predict the amount of fluid pressure required to pass the ball past the shoulder within the device. The temperature within the well may cause the plastic ball to be a different size than at surface temperatures. The temperature within the well may also cause the dimensions of the shoulder to change, but because the shoulder is not comprised of plastic the change in shape may not correlate with the changes reflected in the ball. This may further make it difficult to predict the fluid pressure necessary to pass the plastic ball past the shoulder.

In light of the foregoing, it would be desirable to provide a tool and method to divert fluid flow out of a work string during which the work string would only have to be broken to divert and restore fluid flow. It would further be desirable to provide an annular flow diverting device that used a device that would deform under a predetermined amount of fluid pressure. It would also be desirable to provide a tool and method that only required one dart to be dropped into the work string to divert fluid flow and for which the fluid flow could be restored without the need of an additional dart.

The present invention is directed to overcoming, or at least reducing the effects of, one or more of the issues set forth above.

SUMMARY OF THE INVENTION

The object of the present disclosure is to provide a downhole tool and method to divert fluid flow out of a work string to an annulus. In one embodiment an apparatus for diverting fluid flow out of a working string is disclosed comprising a housing having an internal bore, an upper end, and a lower end wherein the housing has at least one exterior port. The apparatus includes a circulating sleeve having at least one exterior port positioned within the internal bore of the housing. The circulating sleeve is adapted to sealingly slide within the internal bore from an initial position to at least a second position. In the initial position, the circulating sleeve prevents fluid flow from the internal bore to at least one exterior port of the housing. Likewise, when the circulating sleeve is in the initial position, the housing prevents fluid flow through the at least one exterior port of the circulating sleeve. In the second position, the at least one exterior port is aligned with the at least one exterior port of the housing allowing fluid flow to the annulus.

The apparatus further includes a spring positioned to bias the circulating sleeve to its initial position. The embodiment further includes a locating sleeve having a continuous j-track positioned on the circulating sleeve. The locating sleeve being adapted to rotate around the circulating sleeve and travel along the internal bore with the circulating sleeve compressing the spring. The apparatus includes a lower pin connected to the housing and positioned within the continuous j-track and a seat connected to the circulating sleeve, the seat being adapted to catch a dart and block fluid flow through the internal bore of the housing. Fluid pressure above the seat dart moves the circulating sleeve from its initial position to at least the second position within internal bore.

The apparatus may include an upper pin connected to the housing and positioned within a slot of the circulating sleeve, wherein the upper pin radially aligns the at least one exterior port of the circulating sleeve with the at least one exterior port of the housing. The apparatus may include at least one bearing positioned between the circulating sleeve and the locating sleeve.

The dart of the apparatus may be adapted to deform under a predetermined pressure allowing the dart to pass through the seat permitting fluid flow through the internal bore of the housing. The dart may include a shearable device adapted to catch on the seat of the apparatus. The shearable device may be adapted to shear under a predetermined pressure. The dart may include a nose piece, which may be comprised of rubber.

The apparatus may include a cage housing connected to the lower end of the housing, the cage housing having a central bore in communication with the internal bore of the housing and being adapted to catch the deformed dart. The cage housing may include at least one opening in communication with the central bore and may include a structure adapted to retain the deformed dart within the cage housing. The cage housing may be adapted to catch and retain multiple deformed darts.

In one embodiment the continuous j-track of the locating sleeve may include a first shoulder, a second shoulder, a third shoulder, and a fourth shoulder. The lower pin of the apparatus may be positioned at the first shoulder of the continuous j-track when the circulating sleeve is located in its initial position. The lower pin of the apparatus may be positioned at the second shoulder of the continuous j-track when the pressure above a seated dart has moved the circulating sleeve to its second position. The lower pin of the apparatus may be positioned at the third shoulder of the continuous j-track when the pressure above the seated dart is reduced after moving the circulating sleeve to its second position. The lower pin of the apparatus may be positioned at the fourth shoulder of the continuous j-track when the pressure above the dart is increased again. The lower pin of the apparatus may remain at the fourth shoulder of the continuous j-track until the dart deforms under a predetermined pressure. The continuous j-track of the locating sleeve may include a fifth shoulder having the same axial position as the first shoulder but at a different radial location around the perimeter of the location sleeve. The lower pin of the apparatus may be positioned at the fifth shoulder of the continuous j-track after the dart deforms and passes the seat.

The upper end of the housing of the apparatus may be connected to a work string. The lower end of the cage housing of the apparatus may be connected to a work string.

One embodiment of the present invention may be used to circulate fluid into the annulus surrounding the work string at a particular location. As discussed above, drilling mud may be entering into a porous well formation instead of properly circulating the drill cuttings to the surface. The present invention may reduce the time required to inject a sealing agent the work string, circulate the sealing agent into the annulus, and return the work string to normal flow. The present invention may also reduce circulating time and increase hole cleaning efficiency in upper annuli when used in connection with a tapered work string. The present invention could be in various other applications, such as to allow increased velocity while displacing mud to clear brine fluids, as would be appreciated by one of ordinary skill in the art having the benefit of this disclosure.

One embodiment of the present disclosure is a method for diverting fluid flow out of a work string comprising the steps of disconnecting the work string at the surface, inserting a dart into the work string wherein the dart is adapted to deform under a predetermined pressure, reconnecting the work string, and pumping fluid down the work string wherein the dart travels down the work string. The method further includes catching the dart with a seat of a tool connected along the work string, the tool having a central bore in fluid communication with the work string and an exterior fluid port in communication with the central bore. The seated dart blocks the fluid flow path through the central bore of the tool. The method includes biasing a sleeve having an exterior fluid port, the sleeve being located within the housing wherein the sleeve in its initial position prevents communication between the central bore of the tool and the exterior fluid port of the tool. The method further includes increasing the fluid pressure above the seated dart and moving the sleeve along the central bore of the tool until the exterior fluid port of the sleeve aligns with the exterior fluid port of the housing. Once aligned, the method includes pumping fluid through the aligned ports.

The method may include deforming the dart caught within the seat of the tool, wherein the work string does not need to be disconnected a second time to deform the dart. The method may include reducing the fluid pressure above the dart to move the sleeve to a third position, wherein in the third position the sleeve prevents communication between the central bore of the tool and the exterior fluid port of the tool. The method may further include increasing the fluid pressure above the seated dart to move the sleeve to a fourth position, in the fourth position the sleeve prevents communication between the central bore of the tool and the exterior fluid port of the tool. The method may further include increasing the fluid pressure above the dart to a predetermined pressure causing the dart to deform and pass through the seat of the tool. The method may include returning the sleeve to its initial position and catching the deformed dart with a cage housing located below the seat. The method may further include retaining the deformed dart within the cage housing. The method may further include diverting fluid flow out of the work string a second time by inserting a second dart into the work string.

One embodiment is an apparatus for diverting fluid flow out of a work string comprising a housing having a central bore, an upper end, a lower end, and a fluid port through the housing. The apparatus includes a circulating sleeve having a fluid port through the sleeve, the sleeve being positioned within the central bore of the housing and being adapted to move along the central bore of the housing. The apparatus includes means for biasing the circulating sleeve to an initial position, wherein in the initial position the circulating sleeve prevents fluid communication between the central bore of the housing and the fluid port through the housing. The means for biasing may be a spring located within a spring housing. Alternatively, the means for biasing may be a pressurized fluid chamber or other means that would be appreciated by one of ordinary skill in the art having the benefit of this disclosure.

The apparatus includes a locating sleeve positioned between the housing and the circulating sleeve, the locating sleeve including means for retaining the circulating sleeve in a plurality of positions within the central bore. The apparatus include means for catching a dart within the housing, wherein fluid pressure above the caught dart moves the circulating sleeve from its initial position to a second position aligning the fluid port through the housing with the fluid port through the sleeve. The dart may be deformable under a predetermined position.

The apparatus may further include means for axially aligning the fluid port through a housing and the fluid port through the sleeve. The means for axially aligning may be a pin positioned within a slot or groove in the circulating sleeve. Alternatively, the means for axially aligning may be a protrusion on the circulating sleeve that is positioned within a track on the housing. The apparatus may further include means for catching the deform dart beneath the locating sleeve. The apparatus may include means for retaining the deformed dart within the means for catching the deformed dart. The means for catching the deformed dart may further comprise means for catching a plurality of deformed darts.

One embodiment of the present disclosure is a dart for use in a tool used to divert fluid flow out of a work string, the dart including a body, at least one sealing element connected around the exterior of the body, a nose connected to the down hole end of the body, and at least one shearable element connected to the exterior of the body. The shearable element is sized to be retained within a seat of a tool along the work string. The shearable element of the dart may be adapted to shear under a predetermined force. The nose of the dart may be comprised of rubber or another energy absorbing material as would be recognized by one of ordinary skill in the art having the benefit of this disclosure.

Figure 1:
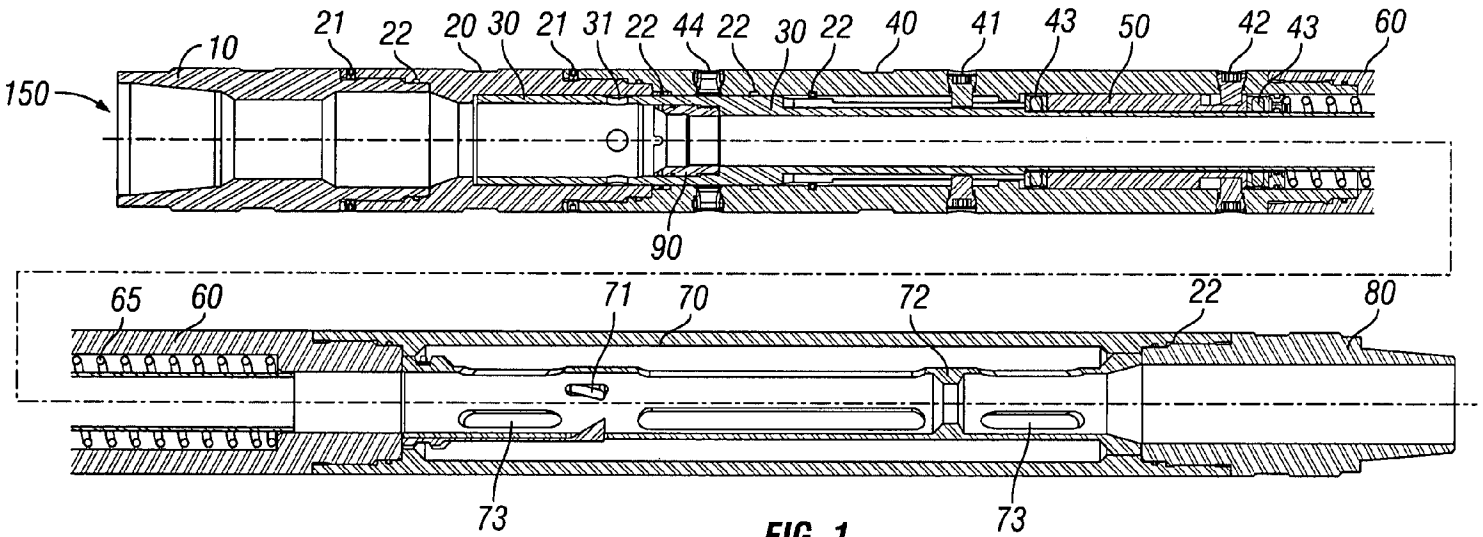
FIG. 1 shows one embodiment of the present disclosure of an annular flow circulating tool, wherein a circulating sleeve 30 located within a housing 40 is in its initial position.

While the invention is susceptible to various modifications and alternative forms, specific embodiments have been shown by way of example in the drawings and will be described in detail herein. However, it should be understood that the invention is not intended to be limited to the particular forms disclosed. Rather, the intention is to cover all modifications, equivalents and alternatives falling within the spirit and scope of the invention as defined by the appended claims.

DESCRIPTION OF ILLUSTRATIVE EMBODIMENTS

Illustrative embodiments of the invention are described below as they might be employed in an apparatus of method of diverting fluid flow out of a work string. In the interest of clarity, not all features of an actual implementation are described in this specification. It will of course be appreciated that in the development of any such actual embodiment, numerous implementation-specific decisions must be made to achieve the developers' specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

Further aspects and advantages of the various embodiments of the invention will become apparent from consideration of the following description and drawings.

FIG. 1 shows one embodiment an annular flow circulating tool having a housing extension 20 connected to a top sub 10 on one end and connected to a ported housing 40 on the other end. Fasteners 21 may be used to connect the top sub 10 to the housing extension 20 and the housing extension 20 to the ported housing 40. The circulating tool further includes sealing elements 22 to prevent fluid from flowing between the interface between each component. The upper portion of the top sub 10 is adapted to connect to tubing or a work string. The top sub 10, housing extension 20, and ported housing 40 may be configured as a single housing or as two housings instead of the three components shown in FIG. 1 as would be appreciated by one of ordinary skill in the art having the benefit of this disclosure.

The top sub 10, the housing extension 20, and the ported housing 40 each include a central bore 150 for fluid flow through the components. The ported housing 40 also circulating ports 44, an upper locating pin 41, and a lower locating pin 42. The ported housing 40 includes four ports 44 located radially around the housing, but the number of ports may be varied as would be appreciated by one of ordinary skill in the art. The bottom of the ported housing 40 is connected to a spring housing 60, which is connected on the other end to a cage housing 70. The bottom of the cage housing 70 is connected to a bottom sub 80 which is adapted to be connected to tubing or a work string. The bottom sub, the cage housing 70, and the spring housing 60 each include a central bore that permit fluid flow through the assembly.

A circulating sleeve 30 is located within the central bore 150 of the ported housing 40. The circulating sleeve 30 is adapted to sealingly slide within the central bore 150. A spring 65 within the spring housing 60 biases the circulating sleeve 30 to an initial position. In its initial position, the circulating sleeve 30 prevents fluid communication between the central bore 150 and the circulating ports 44 of the ported housing 40. Sealing elements 22 may be provided between the ported housing 40 and the circulating sleeve 30 to prevent fluid from leaking between the ported housing 40 and the circulating sleeve 30.

The circulating sleeve 30 includes fluid ports 31 that are sealed of by the ported housing 40 when the circulating sleeve 30 is in its initial position. A seat 90 having a central bore is connected to the interior of the circulating sleeve 30. In an alternative embodiment, the sleeve may be formed with an integral seat. The seat 90 is adapted to catch a dart 100 (shown in FIG. 2) as the dart travels down the work string and passes through the central bore 150. The seated dart blocks the fluid flow through the central bore 150. As fluid is pumped down the work string fluid pressure increases above the dart 100. When the force exerted on the seated dart 100 due to the pumped fluid is greater than the spring force of the spring 65, the circulating sleeve 30 will travel along the central bore until it reaches a second position shown in FIG. 2.

Figure 2:
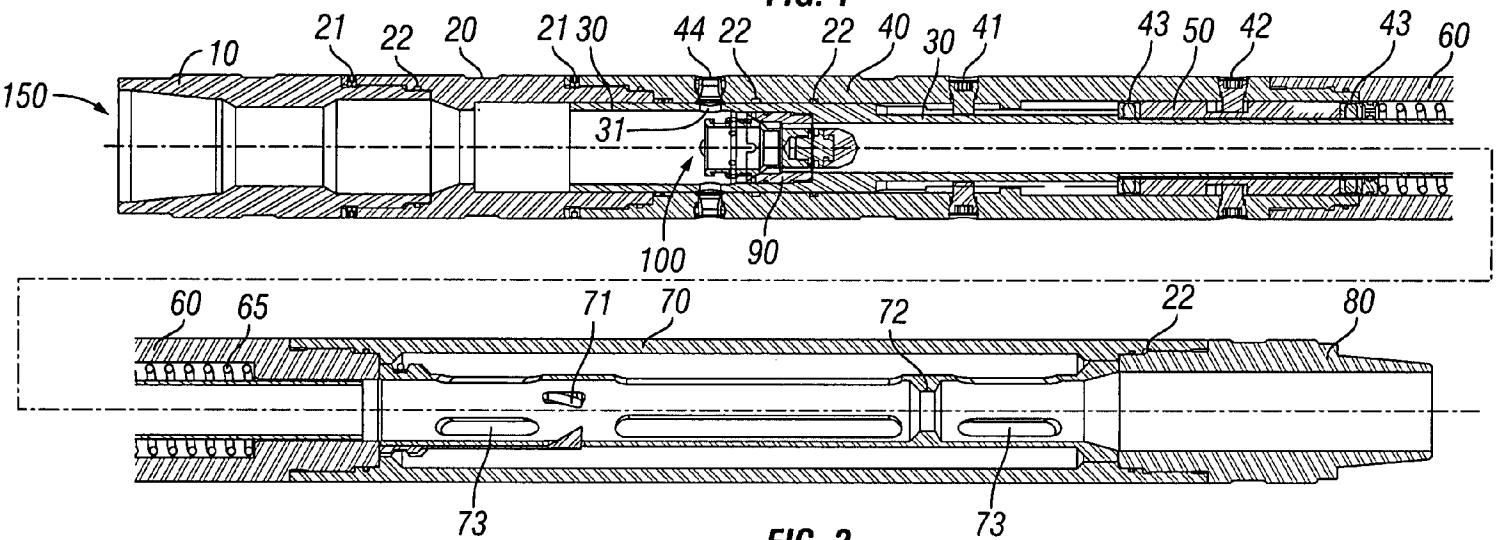
FIG. 2 shows the annular flow circulating tool of FIG. 1 wherein a dart 100 has landed on a seat 90 within the housing 40 and the circulating sleeve 30 has moved to a second position allowing fluid flow through ports 31, 44 to the annulus.

FIG. 2 shows the circulating sleeve 30 in a second position wherein the ports 31 of the circulating sleeve 30 are aligned with the ports 44 of the ported housing 40. The alignment of the ports 31, 44 allows fluid flow to be diverted out of the tool and into the annulus. The ported housing 40 includes an upper pin 41 that prevents rotation of the circulating sleeve 30 with respect to the ported housing 40. The upper pin 41 ensures that the ports 31 of the circulating sleeve 30 will be radially aligned with the ports 44 of the ported housing 40.

A locating sleeve 50 is positioned between the lower portion of the circulating sleeve 30 and the ported housing 40. The locating sleeve 50 is adapted to rotate around the perimeter of the circulating sleeve 30 as the circulating sleeve 30 moves along the central bore 150 of the tool. The tool may include bushings 43 to aid in the rotation of the locating sleeve 50 with respect to the circulating sleeve 30. The end of a lower pin 42 connected to the ported housing 40 is positioned to travel in a continuous j-track 200 (shown in FIG. 6) of the locating sleeve 50. The continuous j-track 200 is adapted to retain the circulating sleeve 30 in the second position until annular circulation is no longer desired. The operation of the continuous j-track and the positioning of the lower pin 42 are discussed in more detail below with respect to FIG. 6.

The pumping of fluid at the surface is reduced or stopped when diverting the fluid flow to the annulus is no longer necessary. The reduction of fluid pressure allows the spring to push the circulating sleeve 30 to a third position. In the third position the ports 31, 44 are no longer aligned and fluid flow to the annulus is prevented. However, fluid flow through the central bore 150 of the tool is still blocked by the seat dart 100. To restore fluid flow through the tool, fluid is pumped from the surface building pressure above the seat dart. The circulating sleeve 30 is moved to a fourth position as shown in FIG. 3.

Figure 3:
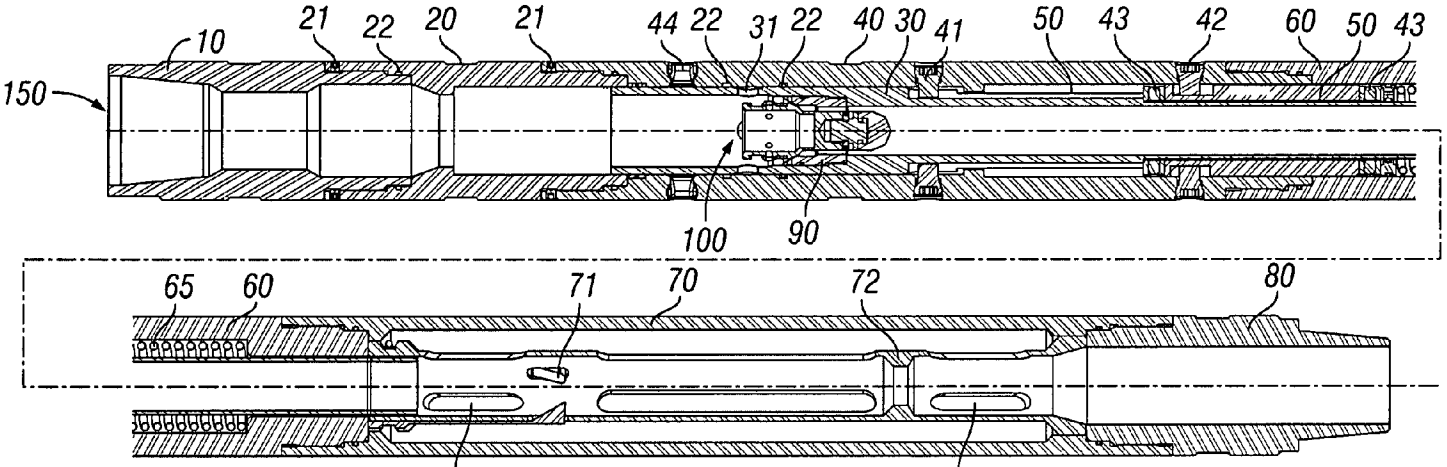
FIG. 3 shows the annular flow circulating tool of FIG. 1 wherein fluid flow is no longer allowed to the annulus and prior to passing the dart 100 past the seat 90.

FIG. 3 shows the circulating sleeve 30 in a fourth position prior to restoring fluid flow through the tool. In the fourth position the ports 31, 44 are not aligned preventing fluid flow into the annulus and allowing fluid pressure to build above the seated dart 100. The dart 100 is adapted to deform under a predetermined amount of fluid pressure. In the fourth position the circulating sleeve 30 has traveled as far as it can along the central bore 150 of the ported housing 40. The dart 100 deforms and passes the seat 90 when the fluid pressure above the dart 100 reaches the predetermined amount. The deformed dart 100 is caught in the cage housing 70 located below the spring housing 60 as shown in FIG. 4.

Figure 4:
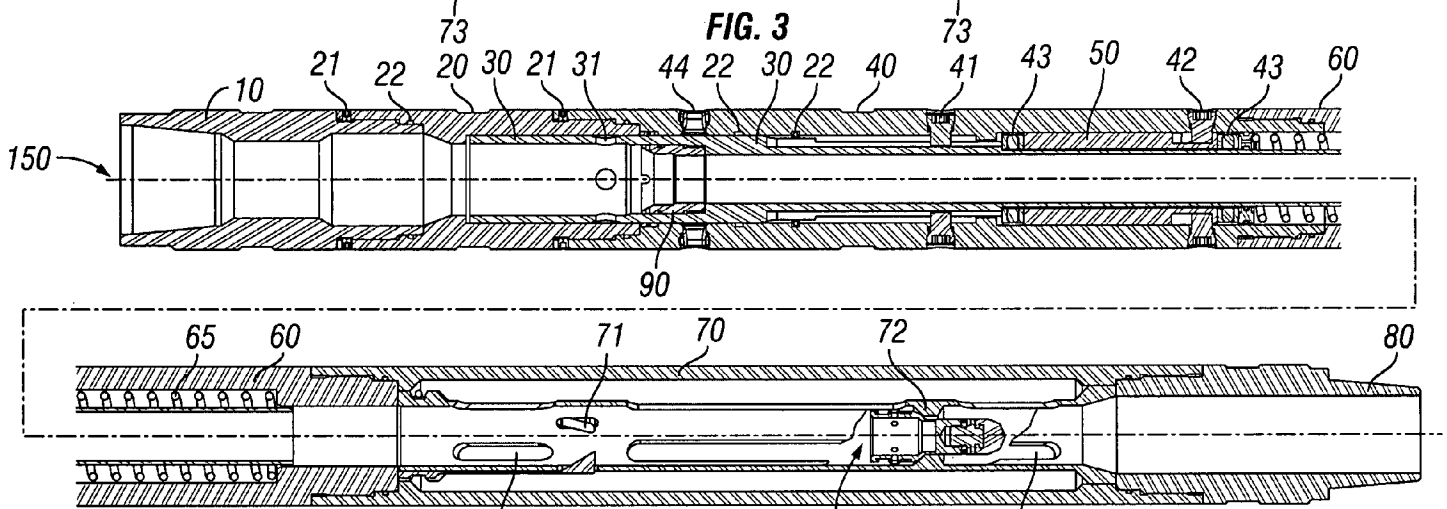
FIG. 4 shows the annular flow circulating tool of FIG. 1 wherein the dart 100 has passed the seat 90 allowing fluid flow through the device and down the work string.

FIG. 4 shows a deformed dart caught in the cage housing 70 after passing by the seat 90. The cage housing 70 includes at least one opening 73 that permits fluid flow past the cage housing 70. The cage housing includes a structure 72 adapted to catch the dart as it travels through the cage housing 70. The cage housing 70 may also include a retention device 71 that prevents the deformed dart 100 from exiting the cage housing 70 due to fluid flow up the work string and the tool. The length of the cage housing 70 could be adapted to catch and retain a various number of deformed darts.

Once the dart 100 is deformed and passes through the seat 90, fluid flow is restored through the tool releasing the fluid pressure previously above the circulating sleeve 30. The release of pressure allows the spring 65 to slide the circulating sleeve 30 back to its initial position. The movement of the circulating sleeve 30 rotates the locating sleeve 50 such that the lower pin 42 is located in the same axial location along the continuous j-track 200 as discussed below.

Figure 5:
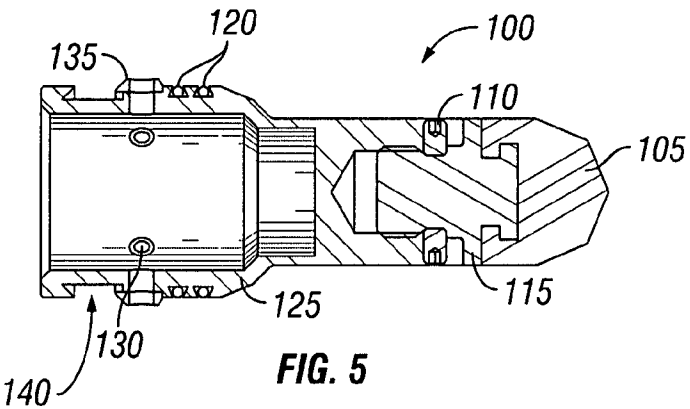
FIG. 5 shows one embodiment of a dart 100 that may be used with the annular flow circulating tool disclosed herein.

FIG. 5 shows one embodiment of a dart 100 that may be used with the annular flow circulating tool disclosed herein. The dart includes a nose piece 105 that is connected to a dart body 125 by an adapter 115. A fastener 110 may be used to connect the nose piece 105 to the adapter 115 allowing the nose piece 105 to be replaceable. The nose piece 105 is adapted to prevent damage to the tool and may be comprised of rubber or another energy absorbing material. The dart body 125 includes a sealing element 120 such as an o-ring to ensure a seal is made when the dart 100 is caught by the seat 90 of the tool. The dart 100 includes a shearable device 130 such as a shear screw and a snap ring 135. The shearable device 130 may be adapted to shear under a predetermined force. Upon shearing the shearable device 130, the snap ring 135 moves along the dart body into the recess portion 140 allowing the dart 100 to pass the seat 90. The use of a shearable device 130 allows the dart 100 to be designed to pass the seat 90 under a predetermined pressure despite the downhole temperature.

Figure 6:
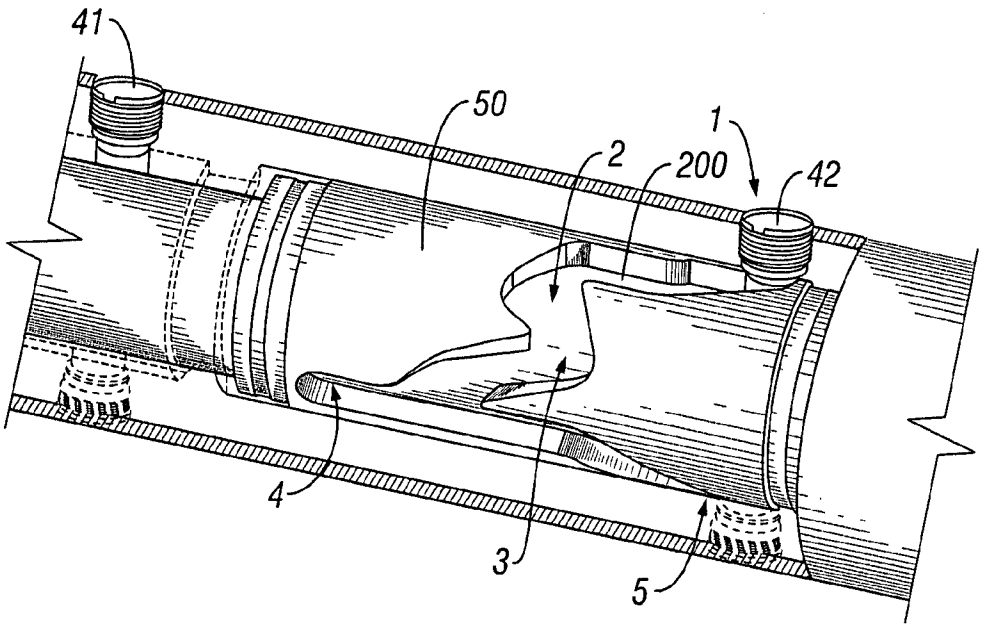
FIG. 6 shows one embodiment of a locating sleeve 50 having a continuous j-track.

FIG. 6 shows the lower pin 42 positioned at a first shoulder 1 of the continuous j-track 200 of the locating sleeve 50. When the lower pin 42 is located in the first shoulder 1 the circulating sleeve 30 is positioned in its initial position. The locating sleeve 50 rotates and the lower pin 42 travels along the continuous j-track 200 as the pressure pushes the locating sleeve 50 along with the circulating sleeve 30 along the central bore 150 of the tool. The lower pin 42 stops at the second shoulder 2 when the ports 31, 44 are aligned allowing fluid flow out of the tool to the annulus. When the fluid pressure is reduced the spring 65 pushes the locating sleeve 50 up rotating the locating sleeve 50 until the lower pin 42 is located in the third shoulder 3. At this location, the ports 31 of the circulating sleeve 30 are no longer aligned with the ports 44 in the ported housing 40.

As discussed above, the fluid pressure is increased to deform the seated dart 100 and restore the fluid flow through the central bore 150 of the tool. The increase in fluid pressure causes the rotation of the locating sleeve 50 as well as pushing the locating sleeve 50 and the circulating sleeve 30 down the central bore compressing the spring 65. The rotation and movement of the locating sleeve 50 positions the lower pin 42 at the fourth shoulder 4. The locating sleeve 50 will remain in this position until the dart 100 is deformed and moves past the seat 90. The release of pressure allows the spring 65 to push the locating sleeve 50 and the circulating sleeve 30 back to its initial location. The movement and rotation of the locating sleeve 50 positions the lower pin 42 to a fifth shoulder 5. The fifth shoulder 5 is located at the same axial distance along the locating sleeve 50 as the first shoulder 1. The j-track 200 is repeated on the other side of the locating sleeve 50. The continuous j-track 200 provides that the device may be cycled from diverting flow out of the tool back to flow through the central bore 150 of the tool with the use of a single dart 100.

Although various embodiments have been shown and described, the invention is not so limited and will be understood to include all such modifications and variations as would be apparent to one skilled in the art.

What is claimed is:

1. An apparatus for diverting fluid flow out of a work string, the apparatus comprising:

a housing having an internal bore, an upper end, and a lower end, wherein the housing has at least one exterior port;

a circulating sleeve positioned within the internal bore of the housing, the circulating sleeve having at least one exterior port, wherein the circulating sleeve is adapted to sealingly slide within the internal bore of the housing from an Initial position to at least a second position, wherein in the second position the at least one exterior port of the circulating sleeve is aligned with the at least one exterior port of the housing;

a spring, the spring positioned to bias the circulating sleeve to its initial position;

a locating sleeve positioned on the circulating sleeve, the locating sleeve having a continuous j-track, wherein the locating sleeve rotates round the circulating sleeve and moves with the circulating sleeve along the internal bore of the housing compressing the spring;

a lower pin having an interior end and exterior end, the exterior end being connected to the housing and the interior end positioned within the j-track; and a seat connected to the circulating sleeve, the seat being adapted to catch a dart and block the internal bore of the housing, wherein fluid pressure above the dart moves the circulating sleeve from the initial position to the second position within the internal bore, the dart being adapted to deform under a predetermined pressure allowing the dart to pass through the seat, thereby enabling fluid flow through the internal bore of the housing.

2. The apparatus of claim 1 further comprising an upper pin, the upper pin connected to the housing and is positioned within a slot of the circulating sleeve, wherein the upper pin radially aligns the at least one exterior port of the circulating sleeve with the at least one exterior port of the housing.

3. The apparatus of claim 1 further comprising a cage housing having an upper end and a lower end, the upper end of the cage housing being connected to the lower end of the housing, wherein the cage housing has a central bore in communication with the internal bore of the housing and the cage housing is adapted to catch the deformed dart.

4. The apparatus of claim 3, the cage housing further comprising at least one opening in communication with the central bore.

5. The apparatus of claim 4, the cage housing further comprising a structure adapted to retain the deformed dart within the cage housing.

6. The apparatus of claim 5 wherein the cage housing is adapted to catch and retain multiple deformed darts.

7. The apparatus of claim 1, the dart further comprising a shearable device adapted to catch on the seat.

8. The apparatus of claim 7 wherein the shearable device is adapted to shear under a predetermined pressure.

9. The apparatus of claim 1, the dart further comprising a nose piece.

10. The apparatus of claim 9 wherein the nose piece is rubber.

11. The apparatus of claim 1 wherein the continuous j-track has a first shoulder, a second shoulder, a third shoulder, and a fourth shoulder.

12. The apparatus of claim 11 wherein the lower pin is positioned at the first shoulder when the circulating sleeve is in its initial position.

13. The apparatus of claim 12 wherein the lower pin is positioned at the second shoulder when pressure above to dart has moved the circulating sleeve to its second position.

14. The apparatus of claim 13 wherein the lower pin is positioned at to third shoulder when the pressure above the dart is reduced after to circulating sleeve has moved to its second position.

15. The apparatus of claim 14 wherein the lower pin is positioned at the fourth shoulder when pressure above the dart is again increased.

16. The apparatus of claim 15 wherein the lower pin remains positioned at the fourth shoulder until the dart deforms under a predetermined pressure.

17. The apparatus of claim 16 wherein the continuous j-track includes a fifth shoulder having the same axial position as the first shoulder and a different radial location around the perimeter of the locating sleeve than the first shoulder.

18. The apparatus of claim 17 wherein the lower pin is positioned at the fifth shoulder after the dart deforms and passes the seat.

19. The apparatus of claim 1 further comprising at least one bearing positioned between the circulating sleeve and the locating sleeve.

20. The apparatus of claim 1 wherein the upper end of the housing is connected to a work string.

21. The apparatus of claim 3 wherein the lower end of the cage housing is connected to a work string.

22. A method for diverting fluid flow out of a work string, the method comprising:

disconnecting the work string at the surface;

inserting a dart into the work string at the surface, wherein the dart is adapted to deform under a predetermined pressure;

reconnecting the work string;

pumping fluid down the work string, wherein the dart travels down the work string;

catching the dart within a seat of a tool connected along the work string, the tool having a central bore in communication with the work string and an exterior fluid port in communication with the central bore wherein the seated dart blocks the fluid flow path through the central bore of the tool, the dart being further adapted to pass through the seat once the dart is deformed, thereby enabling fluid flow though the internal bore of the housing;

biasing a sleeve having an exterior fluid port located within the central bore of the tool, wherein the sleeve in an initial position prevents communication between the central bore of the tool and the exterior fluid port of the tool;

increasing the fluid pressure above the dart;

moving the sleeve along the central bore of the tool until the exterior fluid port of the sleeve aligns with the exterior fluid port of the housing; and pumping fluid through the aligned ports.

23. The method of claim 22 further comprising deforming the dart caught within the seat, wherein the work string does not need to be disconnected a second lime to deform the dart.

24. The method of claim 22 further comprising reducing the fluid pressure above the dart to move the sleeve to a third position, wherein in the third position the sleeve prevents communication between the central bore of the tool and the exterior fluid port of the tool.

25. The method of claim 24 further comprising increasing the fluid pressure above the dart to move the sleeve to a fourth position, wherein the fourth position the sleeve prevents communication between the central bore of the tool and the exterior fluid port of the tool.

26. The method of claim 25 further comprising increasing the fluid pressure above the dart to a predetermined pressure wherein the dart deforms and passes through the seat of the tool.

27. The method of claim 26 further comprising returning the sleeve to the initial position.

28. The method of claim 27 further comprising catching the deformed dart within a cage housing located below the seat.

29. The method of claim 28 further comprising retaining the deformed dart within the cage housing.

30. The method of claim 27 further comprising repeating the steps of claim 23 to divert the flow through the work string for a second time.

31. An apparatus for diverting fluid flow out of a work string, the apparatus comprising:

a housing having a central bore, an upper end, a lower end, and a fluid port through the housing;

a circulating sleeve positioned within the central bore of the housing, the sleeve having a fluid port through the sleeve, wherein the circulating sleeve moves along the central bore of the housing;

means for biasing the circulating sleeve to an initial position, wherein in the initial position the circulating sleeve prevents fluid communication between the central bore of the housing and the fluid port through the housing;

a locating sleeve positioned between the housing and the circulating sleeve, the locating sleeve including means for retaining the circulating sleeve in a plurality of positions; and means for catching a dart within the housing, wherein fluid pressure above the dart moves the circulating sleeve to a second position aligning the fluid port through the housing with the fluid port through the sleeve, the dart being adapted to deform under a predetermined pressure allowing the dart to pass through the means for catching the dart, thereby enabling fluid flow through the central bore of the housing.

32. The apparatus of claim 31 further comprising means for axially aligning the fluid port through the housing and the fluid port through the sleeve.

33. The apparatus of claim 31 further comprising means for catching the deformed dart, wherein the means for catching the deformed dart is located beneath the locating sleeve.

34. The apparatus of claim 33 wherein the means for catching the deformed dart further comprises means for retaining the deformed dart within the means for catching the deformed dart.

35. The apparatus of claim 34 wherein the means for catching the deformed dart further comprising means for catching a plurality of deformed darts.

36. A dart for use in a tool used to divert fluid flow out of a work string, the dart comprising:

a body;

at least one sealing element connected wound the exterior of the body;

a recessed portion located around the exterior of the body;

a nose connected to the body, wherein the nose is located on the down hole end of the dart; and at least one shearable element connected to the exterior of the body, wherein the shearable element is sized to be retained within a seat of a tool along a work string and the shearable element is adapted to shear under a predetermined force, wherein, once the shearable element is sheared, the shearable element is adapted to move along the exterior of the body and into the recessed portion.

37. The dart of claim 36 wherein the nose is comprised of an energy absorbing material.

38. The dart of claim 37 wherein the nose is rubber.

39. The apparatus of claim 1 further comprising a caged housing connected to the lower end of the housing, the caged housing comprising an outer tubular body having an inner tubular body extending therethrough such that an annulus is present between the outer and inner tubular bodies, the inner tubular body being adapted to catch the deformed dart and to allow fluid flow through the inner tubular body and around the deformed dart via the annulus.

* * * * *

UNITED STATES PATENT AND TRADEMARK OFFICE

CERTIFICATE OF CORRECTION

PATENT NO. : 7,520,336 B2
APPLICATION NO. : 11/654350
DATED : April 21, 2009
INVENTOR(S) : Maximiliano Mondelli et al.

It is certified that error appears in the above-identified patent and that said Letters Patent is hereby corrected as shown below:

Col. 11, claim 30 should read
30. The method of claim 27 further comprising repeating the steps of claim 22 to divert the flow through the work string for a second time.

Signed and Sealed this
First Day of February, 2011

David J. Kappos
*Director of the United States Patent and Trademark Office*

UNITED STATES PATENT AND TRADEMARK OFFICE

CERTIFICATE OF CORRECTION

PATENT NO. : 7,520,336 B2
APPLICATION NO. : 11/654350
DATED : April 21, 2009
INVENTOR(S) : Maximiliano Mondelli et al.

It is certified that error appears in the above-identified patent and that said Letters Patent is hereby corrected as shown below:

Col. 11, lines 15-17, claim 30 should read
30. The method of claim 27 further comprising repeating the steps of claim 22 to divert the flow through the work string for a second time.

This certificate supersedes the Certificate of Correction issued February 1, 2011.

Signed and Sealed this
First Day of March, 2011

David J. Kappos

David J. Kappos
*Director of the United States Patent and Trademark Office*